US007457553B2

(12) United States Patent
Igarashi

(10) Patent No.: US 7,457,553 B2
(45) Date of Patent: Nov. 25, 2008

(54) IMAGE-FORMING DEVICE AND TRANSFER DEVICE HAVING A DENSITY SENSOR AND BLOCKING MEMBER

(75) Inventor: Hiroshi Igarashi, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 122 days.

(21) Appl. No.: 11/388,988

(22) Filed: Mar. 27, 2006

(65) Prior Publication Data

US 2006/0228124 A1 Oct. 12, 2006

(30) Foreign Application Priority Data

Mar. 28, 2005 (JP) ..... 2005-092559

(51) Int. Cl.
*G03G 15/00* (2006.01)
*G03G 21/00* (2006.01)

(52) U.S. Cl. ..... 399/49; 399/98

(58) Field of Classification Search ..... 399/49, 399/71, 72, 74, 101, 98
See application file for complete search history.

(56) References Cited

U.S. PATENT DOCUMENTS 5,848,333 A * 12/1998 An ..... 399/167
6,321,044 B1 11/2001 Tanaka
7,020,404 B2 * 3/2006 Fukuda et al. ..... 399/49
7,200,346 B2 * 4/2007 Chigira ..... 399/49
7,231,157 B2 * 6/2007 Kitayama ..... 399/49
2006/0029408 A1 * 2/2006 Suzuki et al. ..... 399/49

FOREIGN PATENT DOCUMENTS

JP 08-286494 A * 11/1996
JP 11237773 8/1999
JP 2001-175039 A * 6/2001
JP 2002131997 5/2002
JP 2003195578 7/2003
JP 2005-070676 A * 3/2005
JP 2006-003399 A * 1/2006

* cited by examiner

*Primary Examiner*—Sophia S Chen
(74) *Attorney, Agent, or Firm*—Banner & Witcoff, Ltd

(57) ABSTRACT

A blocking disk formed with a notched part is disposed between a density sensor and a belt. The exposure/blocking of the density sensor relative to the belt is switched by rotating the blocking disk. In one example, a disk-supporting axel gear is formed on a disk-supporting axel that is the axis of rotation of the blocking disk, where the disk-driving gear is supported on a sensor frame so as to be able to rotate and so as to mesh with this disk-supporting axel gear. In one example, the disk-driving gear is connected to a driving force transmission mechanism for rotationally driving a belt-driving roller, where, when the belt-driving roller is driven rotationally, the blocking disk is constantly rotated by a disk-driving gear.

25 Claims, 8 Drawing Sheets

IMAGE-FORMING DEVICE AND TRANSFER DEVICE HAVING A DENSITY SENSOR AND BLOCKING MEMBER

RELATED APPLICATIONS

This application claims priority to Japanese Application No. 2005-92559, filed Mar. 28, 2005, whose contents are expressly incorporated herein by reference.

FIELD OF TECHNOLOGY

Aspects of the present invention relate to image-forming devices that form images using a developing agent (toner, etc.). Additionally, aspects of the present invention relate to transfer devices that transfer, to a recording medium (paper, etc.), the developing agent, arranged in the shape of the image, where these transfer devices are provided within the image-forming devices.

RELATED ART

Known image-forming devices include a photosensitive drum and a transfer belt, disposed so as to contact the photosensitive drum. This image-forming device is structured so that toner is arranged in the shape of the image on the photosensitive drum through developing at static electrical latent image, on the photosensitive drum, using toner, where this toner image is first transferred to a transfer belt from the photosensitive drum, and then transferred from the transfer belt to copy paper.

Moreover, this imaging device includes a density sensor for detecting a patch mark image, which is a rectangular toner pattern that is formed on the transfer belt, in order to adjust the density, a shutter plate that is disposed in the light path between this density sensor and the transfer belt, and an electromagnetic solenoid for reciprocally driving this shutter plate. An aperture part, for exposing the detecting surface when performing detection, but that blocks the detecting surface of the density sensor when detection is not necessary, is formed in the shutter plate.

In the image-forming device, an electric current is provided to the electromagnetic solenoid prior to the execution of the toner density adjustment sequence, to perform an aperture opening sequence for having the shutter open the detection surface of the density sensor.

In the image-forming device described above, it is necessary to have an electromagnetic solenoid, for driving the shutter plate, along with driving mechanisms for, for example, the photosensitive drum and the transfer belt, increasing the manufacturing cost of the image-forming device.

SUMMARY

Aspects of the present invention relate to addressing one or more issues described above.

DETAILED DESCRIPTION

It is noted that various connections are set forth between elements in the following description. It is noted that these connections in general and, unless specified otherwise, may be direct or indirect and that this specification is not intended to be limiting in this respect.

Forms of embodiment according to the present invention (that is, forms of embodiment that are considered to be preferable by the applicant at the time of application for the present application) will be explained below in reference to the figures.

Schematic Structure of a Laser Printer

Figure 1:
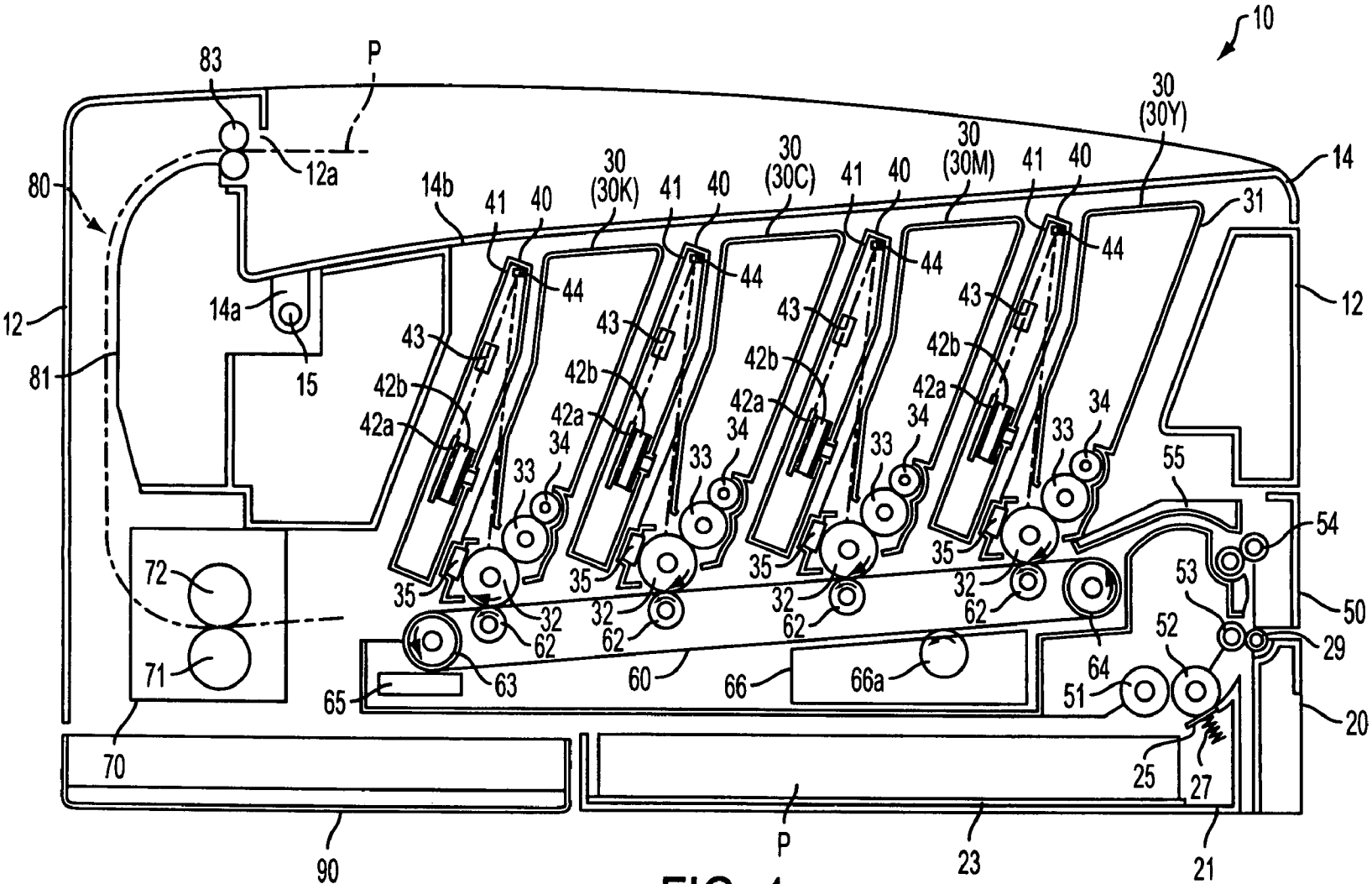
FIG. 1 shows a cross-sectional diagram illustrating schematically the structure of a laser printer according to an embodiment according to the present invention.

FIG. 1 is a cross-sectional diagram of a laser printer 10 that is one example of embodiment of an image-forming device according to the present invention. In the below, the right side in FIG. 1 shall be termed the "front surface" of the laser printer 10, and the left side in FIG. 1 shall be termed the "back surface" of the laser printer 10.

The body casing 12 of the laser printer 10 is fashioned so as to cover the main frame, not shown, for supporting, for example, a driving force transmission mechanism including a motor and gears. A top cover 14 is attached to the top of the body casing 12. A rib 14*a* is formed so as to extend in the downward direction at the bottom edge of the back surface side in the top cover 14. Through holes are formed in the rib 14*a*, where a top cover support shaft 15, provided in the body casing 12, is inserted into the applicable through hole. In this way, the top cover 14 is supported so as to the able to open and close, centered on the top cover support shaft 15. On the top surface of the top cover 14 is formed an ejected paper tray 14*b*, where the ejected paper tray 14*b* is structured so as to be able to accommodate the paper P that has been ejected from an paper-ejecting aperture 12*a* that is formed in the top of the back surface side of the body casing 12.

Paper Supply Cassette

A paper supply cassette 20, structured so as to be able to store, in a stacked state, a sheet-shaped recording medium (printer paper), is attached removably to the bottom part of the body casing 12.

A separating pad 25 for separating the paper into one sheet at a time when the paper is being fed towards the image-forming unit within the body casing 12, for forming the image, along with a paper retaining plate 23, upon which the paper is placed, are provided on the inside of a cassette case 21, which structures the casing of the paper supply cassette 20.

The paper retaining plate 23 is supported swivelably, centered on the edge part of the back surface side (the side that is farthest from the separating pad 25 in FIG. 1). The edge part of the front surface side of the paper retaining plate 23 (the side that is nearest to the separating pad 25 in FIG. 1) is biased in the upward direction by a spring, not shown. The separating pad 25 is disposed in the vicinity of the edge part of the front surface side in the cassette case 21, on the downstream side, in the direction in which the paper is fed, relative to the paper retaining plate 23, and is biased in the upward direction, from below, by a retaining spring 27. The surface on the top side of the separating pad 25 is structured from a material that has a higher coefficient of friction than paper, such as rubber, or the like. A follower roller 29 is disposed at the top edge part of the front surface side of the cassette case 21, on the downstream side of the separating pad 25 in the direction in which the paper is fed. This follower roller 29 is supported, by the cassette case 21, so as to be able to rotate freely in order to fulfill the function of being a guide when each individual sheet of paper P that is separated by the separating pad 25 and conveyed is conveyed towards the image-forming unit.

Process Cartridges

A plurality of process cartridges 30 (30Y, 30M, 30C, and 30K) that include the image-forming unit are attached removably within the body casing 12 above the paper supply cassette 20. The process cartridges 30Y, 30M, 30C, and 30K are arrayed, in this order, from front to back in the laser printer 10. These process cartridges 30Y, 30M, 30C, and 30K contain, respectively, yellow, magenta, cyan, and black toners (developing agents).

A photosensitive drum 32, which forms and electrostatic latent image, a developing roller 33, for holding, on the peripheral surface thereof, toner for developing the electrostatic latent image, and a supply roller 34, for supplying toner to the peripheral this of the developing roller 33, are each held rotatably within a cartridge case 31 that structures the casing of the process cartridge 30.

The photosensitive drum 32 is disposed at the edge part (the bottom edge part in FIG. 1) in the lengthwise direction, when viewed from the side, of the cartridge casing 31, where a portion of the peripheral surface of the photosensitive drum 32 is exposed to the outside from an opening part that is formed at the edge part. The developing roller 33 is structured from a synthetic rubber material, and is disposed so that the peripheral surface of the developing roller 33 makes contact with the photosensitive drum 32. The supply roller 34 is structured from a foam sponge material, and is disposed so as to push against the developing roller 33. The photosensitive drum 32, the developing roller 33, and the supply roller 34, are supply structures so as to be rotated by a driving force transmission mechanism that is provided on the main frame. Moreover, the structure is such that a specific developing bias voltage is applied between the photosensitive drum 32 and the developing roller 33. A charger 35, for uniformly charging the peripheral surface of the photosensitive drum 32, is disposed at a position facing the peripheral surface of the photosensitive drum 32, upstream of the contact position with the developing roller 33, with the contact position with the developing roller 33 in the direction of rotation of the photosensitive drum 32 (the direction indicated by the arrow in figure).

Scanner Unit

A scanner unit 40, for illuminating the photosensitive drum 32 with a laser beam, is disposed within the body casing 12 for each of the process cartridges 30Y, 30M, 30C, and 30K. The scanner unit 40 includes a scanner case 41, a polygon mirror 42*a*, a polygon motor 42*b*, a lens 43, and a reflector mirror 44. The polygon mirror 42*a* is supported by the rotational drive shaft of the polygon motor 42*b*, which is secured to the scanner case 41, so as to enable rotational driving at a specific rate of rotation. The polygon mirror 42*a* is structured so as to enable scanning of the laser beam in the direction of width of the printer paper by reflecting the laser beam, which is produced, based on image data, by a laser photoemitter part not shown, while the polygon mirror 42*a* is driven rotationally by the polygon motor 42*b*. The lens 43 and the reflector mirror 44 are supported within the scanner case 41 so as to be able to direct the laser beam (indicated by the dotted line) that is reflected by the polygon mirror 42*a* onto the peripheral surface of the photosensitive drum 32.

Paper-conveying Unit

A paper-conveying unit 50, for supplying paper towards the process cartridges 30, is provided within the body casing 12. The paper-conveying unit 50 includes a pickup roller 51, a paper supply roller 52, a paper-conveying roller 53, a resist roller 54, and a paper guide 55.

The pickup roller 51 is supported rotatably by the main frame, not shown. This pickup roller 51 is structured so as to be rotatable by a driving force transmission mechanism that is provided on the main frame, and is disposed so as to make contact, with a specific pressure, with the paper P, which is biased in the upward direction by the paper retaining plate 23, during image formation. The paper supply roller 52 is supported rotatably by the main frame, not shown. This paper supply roller 52 is structured so as to be rotatable by a driving force transmission mechanism that is provided on the main frame, and is disposed facing the separating pad 25 so that the peripheral surface of the paper supply roller 52 contacts the separating pad 25 with a specific pressure. The paper conveyor roller 53 is disposed so as to face the follower roller 29, and is supported rotatably by the main frame farther towards the front than the separating pad 25 (that is, in the downstream side in the direction of rotation of the paper supply roller 52 when paper is supplied). This paper conveyor roller 53 is structured so as to be rotatable by a driving force transmission mechanism that is provided on the main frame. The resist rollers 54 include a pair of rollers for adjusting the direction and conveyance timing of the paper, and are structured so as to be rotatable by a driving force transmission mechanism that is provided on the main frame. The paper guide 55 is a member for guiding the paper so that the paper that has passed the resist rollers 54 can be conveyed towards the process cartridges 30.

Transfer Unit

Transfer unit 60, which is an embodiment of a transfer device according to the present invention, is disposed between the paper supply cassette 20 and the plurality of process cartridges 30 (30Y, 30M, 30C, and 30K) within the body casing 12. The transfer unit 60 includes a belt 61, a transfer roller 62, a belt-driving roller 63, a belt-supporting roller 64, a density-detecting unit 65, and a belt cleaner 66.

The belt 61 is formed as an endless belt from an electrically conductive plastic wherein electrically conductive particles, such as carbon, are dispersed into a resin, such as polycarbonate or polyimide. The transfer rollers 62 are supported rotatably facing each of the cartridge processes 30Y, 30M, 30C, and 30K so as to hold the belt 61 therebetween. The transfer rollers 62 are components including the image-forming unit, and are structured so as to allow the application of a transfer bias voltage between the transfer roller 62 and the photosensitive drum 32 so as to transfer toner from the peripheral surface of the photosensitive drum 32 onto the belt 61. Moreover, the transfer roller 62 is structured so as to have a reverse transfer bias applied between the transfer roller 62 and the photosensitive drum 32 so as to transfer onto the paper P an image through the toner that is supported on the surface of the belt 61. The belt 61 is held so as to span between a belt-driving roller 63 and a belt-supporting roller 64 with a specific tension. The belt-driving roller 63 is structured so as to be rotatable in the direction indicated by the arrow in the figure by a driving force transmission mechanism provided on the main frame. This belt-driving roller 63 is disposed in the neighborhood of the process cartridge 30K that is positioned the farthest toward the back surface side of all of the plurality of process cartridges 30. The belt-supporting roller 64 is disposed in the vicinity of the process cartridge 30Y, which is in the position that is farthest toward the front surface, of all of the plurality of process cartridges 30, and is supported so as to be able to rotate in the direction shown by the figure by the arrow, along with the movement of the rotation of the belt 61 by the rotation, in the direction shown in the arrow in the figure, of the belt-driving roller 63. In other words, the belt 61 is supported by the belt-driving roller 63 and the belt-supporting roller 64 below the process cartridges 30Y, 30M, 30C, and 30K, in such a way that the surface thereof moves along the line of photosensitive drum 32 that are provided in the process cartridges 30Y, 30M, 30C, and 30K.

The transfer unit 60 in the present example of embodiment is structured so that the toner is first transfer from the photosensitive drums 32, provided in the process cartridges 30Y, 30M, 30C, and 30K (the image-forming unit) to the belt 61, and the toner, which is arranged in the form of an image is supported only surface of the belt 61 (the image-supporting member), and the toner that is supported on the surface of this belt 61 is then transferred onto the paper P. In other words, there is a gap that is about the thickness of the paper P between the belt 61 and the photosensitive drum 32. Moreover with the transfer bias applied between the transfer roller 62 and the photosensitive drum 32, the surface of the belt 61 passes under the process cartridges 30Y, 30M, 30C, and 30K, so that an image including four colors of toner will be held on the surface, after which the reverse bias voltage is applied between the transfer roller 62 and the photosensitive drum 32 along with having a paper P laid out on the surface, to transfer the toner to the paper P, where the transfer unit 60 is structured so that the paper P onto which this toner has been transferred is conveyed towards a fixing unit 70 by the belt 61. In other words, in the present embodiment, when an image is formed on one sheet of the paper P, the belt 61 makes two cycles, where, in the first cycle, the toner is arranged into the form of the image on the surface of the belt 61, and in the second cycle the toner on the surface of the belt 61 is transferred to the paper P and the paper P is conveyed towards the fixing unit 70, described below.

A density-detecting unit 65 is disposed beneath the belt-driving roller 63. This density-detecting unit 65 is structured so as to be able to produce a signal depending on the density of toner in a mark image that is a pattern of toner that is formed on the belt 61 in order to adjust the density and adjust for shifts in color in the direction of conveyance of the paper (hereinafter termed "image adjustments"). The detailed structure of this density-detecting unit 65 will be described below.

A belt cleaner 66 is disposed below the belt 61 so as to face the front surface of the belt 61. The belt cleaner 66 is provided with a cleaning roller 66*a*, structured so that each time an image is formed for a single paper P sheet, and each time an image adjustment is performed by the density-detecting unit 65, the surface of the belt 61 can be cleaned by the cleaning roller 66*a*. In other words, the belt cleaner 66 is structured so as to move upward and downward with a specific timing so that the cleaning roller 66*a* is removed from the belt when the toner is arranged in the shape of an image during image formation, and the cleaning roller 66*a* is in contact with the belt 61 after the transfer of the toner to the printer P. The cleaner 66 is structured so that the cleaning roller 66*a* is driven rotationally by a driving force transmission mechanism that is provided on the main frame, synchronized with the specific timing.

Fixing Unit

A fixing unit 70 for fixing onto the paper the image from the toner, formed on the paper, is disposed on the downstream side, in the paper-conveying direction, from the transfer unit 60, within the body casing 12. The fixing unit 70 includes a heating roller 71 and a pressure roller 72. The heating roller 71 contains a halogen lamp within a cylinder made from metal, the surface thereof being treated with a release agent, and is structured so as to be rotated by a driving force transmission mechanism provided on the main frame. The pressure roller 72 is a roller made from silicone rubber, and is supported so as to be able to rotate following the heating roller 71, pressed with a specific pressure against the heating roller 71.

Paper-ejecting Unit

At the farthest back side within the body casing 12 is disposed a paper-ejecting unit 80 for ejecting paper, through the fixing unit 70, to the outside of the laser printer 10. The paper-ejecting unit 80 includes the paper-ejecting guide 81 and the paper-ejecting roller 83. The paper-ejecting roller 83 is structured so as to be rotatable by a driving force transmission mechanism that is provided on the main frame, and is disposed in the vicinity of a paper-ejecting aperture 12*a*. The paper-ejecting guide 81 is a member for guiding the paper that has passed the fixing unit 70 to the paper-ejecting roller 83.

Control Unit

A control unit 90 is housed at the bottom of the body casing 12. This control unit 90 is connected electrically to various motors, actuators, sensors, and so forth that are provided on the main frame, and to the laser emitter unit and polygon motor 42*b*, and the like, provided in the scanner unit 40, in order to drive the various parts that are provided in, for example, the process cartridges 30 and the paper-conveying unit 50, so as to be able to control, as appropriate, the operation of the process cartridges 30, the scanner units 40, the paper-conveying unit 50, the transfer unit 60, the fixing unit 70, and the paper-ejecting unit 80. In particular, in the present embodiment, the control unit 90 is structured so as to be able to control the operations of the process cartridges 30 and the transfer rollers 62 (starting and stopping the rotation of the various rollers, the settings and the application timing of the developer bias voltage/transfer bias voltage/reverse transfer bias voltage, etc.) as the image-forming unit, based on signals from the density-detecting unit 65.

Density-detecting Unit

Figure 2A:
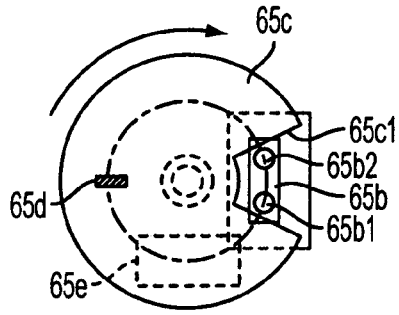
FIGS. 2*a* and 2*b* show expanded cross-sectional diagrams of the vicinity of the density detector unit in the laser printer shown in FIG. 1.
Figure 2B:
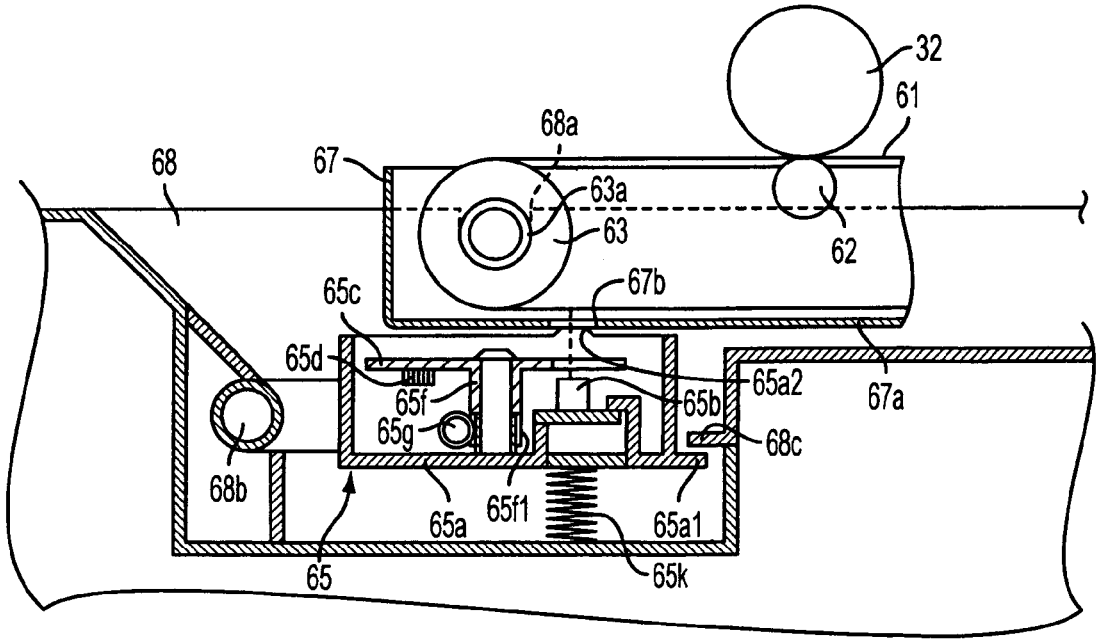

FIGS. 2*a* and 2*b* is an expanded view of the vicinity of the density-detecting unit 65 is a laser printer 10 according to the present example of embodiment (shown in FIG. 1). FIG. 2*a* is an expanded plan view of the various parts thereof, and FIG. 2*b* is a cross-sectional view with the same scale as FIG. 2*a*. FIG. 2*b* shows the density-detecting unit 65 below the belt 61. However, it is appreciated that the density-detecting unit 65 may be located at other positions so as not to be below the belt 61. For instance, the density-detector 65 may be on a side of the belt 61 as it passes a roller (for instance, belt-driving roller 63) or above the belt 61.

Sensor Frame and Transfer Frame Support Structure

Figure 3:
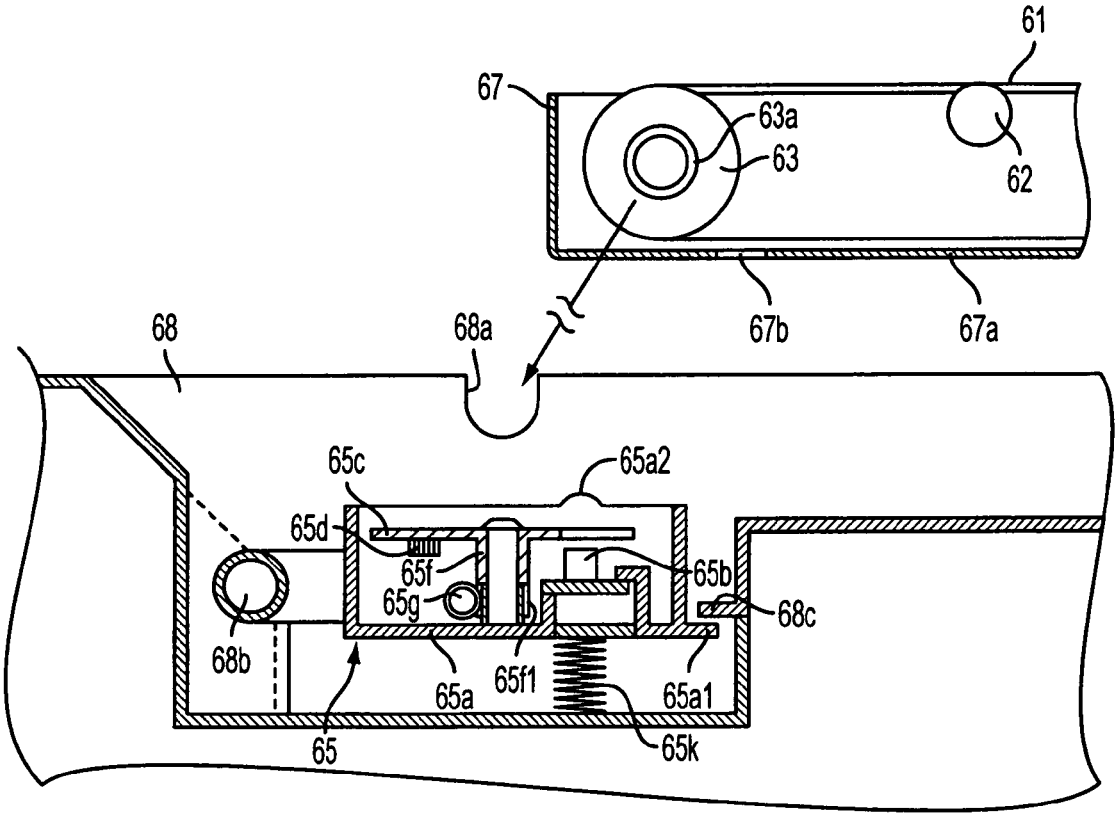
FIG. 3 shows a state wherein the transfer frame shown in FIGS. 2*a* and 2*b* is attached and removed.

Referencing FIG. 2*b*, the transfer frame 67 is structured from a box-shaped member that is open at the top, and supports rotatably the transfer roller 62, the belt-driving roller 63, and the belt-supporting roller 64 (shown in FIG. 1). An aperture part 67*b*, which is a through hole for exposing the surface of the belt 61, is formed facing the downward direction in a transfer frame bottom plate 67*a*, which is a flat plate that structures the bottom plate of the transfer frame 67. This transfer frame 67 is structured to attach removably to the body frame 68. That is, as illustrated in FIG. 3, the transfer frame 67 is attached to the body frame 68 through a rotation center axel 63*a* of the belt-driving roller 63 being accommodated in an indented part 68*a* that is provided, with the opening facing upward, in the top part of the body frame 68 (with the belt-supporting roller 64 side (shown in FIG. 1) structured in the same way). This body frame 68 is a member that structures one part of the main frame, which is covered by the body casing 12 (shown in FIG. 1).

Referencing FIG. 2*b* again, the body frame 68 is provided with a sensor frame support axel 68*b* that is parallel to the belt-driving roller 63, etc. The sensor frame 65*a*, which is the casing for the density-detecting unit 65, centered on the sensor frame support axel 68*b*, the sensor frame 65*a* is supported so as to be able to swivel along a vertical plane that is parallel to the direction of motion of the surface of the belt 61.

Density Sensor and Blocking Disk Structures

Below the opening part 67*b* of the transfer frame bottom plate 67*a* is disposed a density sensor 65*b*. The bottom edge of this density sensor 65*b* is supported by the sensor frame 65*a*. The density sensor 65*b* is provided with a light-emitting unit 65*b*1 and a light-receiving unit 65*b*2, structured so that the light that is emitted from the light-emitting unit 65*b*1 is reflected at the surface of the belt 61 and the intensity of the reflected light is detected by the light-receiving unit 65*b*2 to generate a signal according to the density of the toner that is adhered to the surface of the belt 61.

The blocking disk 65*c* for blocking intermittently the light beam of the density sensor 65*b* and the belt 61 is disposed between the density sensor 65*b* and the belt 61. This blocking disk 65*c* is supported by the sensor frame 65*a* so as to be able to rotate around a vertical line. A notched part 65*c*1 (shown in FIG. 2*a*) is formed in the blocking disk 65*c*. That is, the blocking disk 65*c* is structured so as to form the light path (that is, the "exposed state") by exposing the density sensor 65*b* to the belt 61 when the notched part 65*c*1 is positioned above the density sensor 65*b*. The density-detecting unit 65 may be structured so as to be able to continually change the state of the blocking disk 65*c* between the exposed state and the blocked state through the blocking disk 65*c* rotating in a plane that is parallel to the horizontal plane. Furthermore, the bottom surface of the blocking disk 65*c* (the surface that is facing the density sensor 65*b*) can have a matte finish formed on the surface, and may be coated, for example, with a light-deadening black color so as to reduce insofar as possible the amount of light received by the light-receiving unit 65*b*2 (so that the amount of light that is received when the maximum density of black toner is supported on the surface of the belt 61, when the light path is formed, will be adequately small).

A cleaning brush 65*d* for removing toner and foreign material, such as dust, that adheres to the light-emitting unit 65*b*1 and the light-receiving unit 65*b*2 of the density sensor 65*b* is attached to the bottom surface of the blocking disk 65*c*. A reference plate 65*e* for the calibration of the density sensor 65*b* is attached to the bottom surface of the blocking disk 65*c*. The equivalent of a reference white plate (or any other color plate) is a reflective density meter used as this reference plate 65*e*. For instance, a color plate may be used when all colors C, M, Y, and Bk can be referenced against it. That is, the reference plate 65*e* is positioned above the density sensor 65*b*, and the surface of the reference plate 65*e* is structured so as to increase as much as possible the amount of light received by the light-receiving unit 65*b*2 when the light emitted by the light-emitting unit 65*b*1 is reflected on the surface of the reference plate 65*e* and detected by the light-receiving unit 65*b*2 (so that the amount of light will be adequately larger than the amount of light that is received when there is no toner whatsoever on the surface of the belt 61 when the light path is formed).

A disk-supporting axel 65*f*, that forms the axis of rotation of the blocking disk 65*c*, is formed facing the downward direction from the center of the blocking disk 65*c*, when viewed from above. A disk-supporting axel gear 65*f*1 is formed at the bottom end part of the disk-supporting axel 65*f*. A disk-driving gear 65*g*, positioned so as to mate with this disk-supporting axel gear 65*f*1, is supported on the sensor frame 65*a*. This disk-driving gear 65*g* is structured so as to be driven by the driving force from a driving force transmission mechanism for driving the belt-driving roller 63. That is, the driving force transmission mechanism and disk-driving gear 65*g* for driving the belt-driving roller 63 are linked directly, without going through a power transmission cutoff means (such as a clutch, or the like). So that when the belt-driving roller 63 is driven, the driving force may be transmitted to the disk-driving gear 65*g* and the disk-supporting gear 65*f*1. Alternatively, the driving force may be alternatively provided to belt-driving roller 63 and the disk-driving gear 65*g* (for instance, through the use of planetary gears).

As described above, the density-detecting unit 65 in the present embodiment is structured so that the density sensor 65*b* generates a signal according to the density of the toner on the surface of the belt 61 and also to be able to generate a signal according to the state (the angular phase) of the blocking disk 65*c*.

Structure for Positioning the Sensor Frame and the Transfer Frame

A sensor frame push-up spring 65*k* for biasing the sensor frame 65*a* in the upward direction is disposed below the sensor frame 65*a*. A tongue piece 65*a*1 is structured so as to protrude at the bottom end part of the free end side (the side that is farthest from the center of the swiveling) of the sensor frame 65*a*. This tongue piece 65*a*1 is structured so as to be able to control the rise position of the sensor frame 65*a*, by making contact with a stopper 68*c*, which is provided protruding from the body frame 68 towards the sensor frame 65*a*, when the transfer frame 67 is separated from the body frame 68, as shown in FIG. 3.

Referencing FIGS. 2*a* and 2*b* again, a protruding part 65*a*2 is formed at the top end part that is opposite from the transfer frame 67 of the sensor frame 65*a*. This protruding part 65*a*2 is structured so as to perform the positioning of the sensor frame 65*a* and the transfer frame 67, by coming into contact with the transfer frame bottom plate 67*a* (that is, this protruding part 65*a*2 sets the clearance between the density sensor 65*b* and the belt 61). This protruding part 65*a*2 is structured so that, with the sensor frame 65*a* in contact with the transfer frame 67, the apex of the protruding part 65*a*2 is positioned on a line that is normal to the surface of the belt 61 from the density sensor 65*b* when viewed from the side.

That is, the sensor frame 65*a* in the present embodiment is supported by the body frame 68 and the sensor frame support axel 68*b* so as to be able to swivel between a contact position (that is in contact with the transfer frame 67, as shown in FIG. 2*b*), a separated position (wherein the sensor frame 65*a* is separated from the transfer frame 67 by being shifted somewhat downwards from the contact position), and an upper limit position (constrained by the stopper 68*c*, when the transfer frame 67 is removed from the body frame 68, as shown in FIG. 3).

Furthermore, in the present example of embodiment, the sensor frame 65*a*, the transfer frame 67, and the body frame 68 are structured so that, when in the "contact position," shown in FIG. 2*b*, the bottom surface of the sensor frame 65*a* is parallel to the horizontal plane, and the light path between the density sensor 65*b* and the belt 61 is parallel to a vertical line.

Structure of the Driving Force Transmission Mechanism within the Laser Printer

Figure 4:
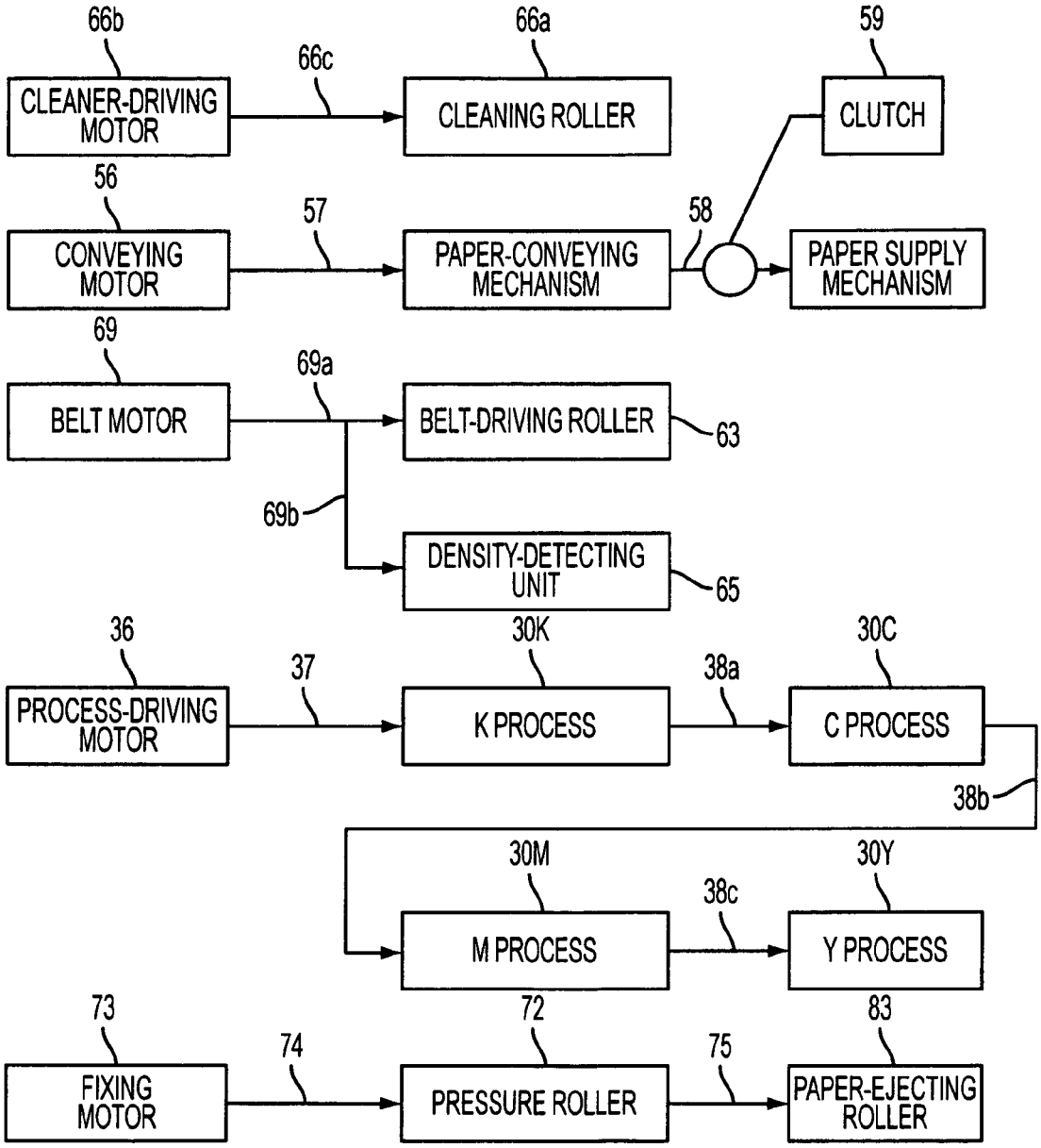
FIG. 4 is a block diagram illustrating the structure of a driving force transmission mechanism in a laser printer that includes an embodiment of a blocking plate driving unit.

FIG. 4 is a block diagram for explaining the structure of the driving force transmission mechanism in the laser printer according to the present embodiment (shown in FIG. 1). On the main frame within this laser printer 10, are installed a process-driving motor 36 for driving the process cartridges 30 (30Y, 3GM, 30C, and 30K), a conveying motor 56 for driving the paper-conveying unit 50, a cleaner-driving motor 66*b* for driving the cleaning roller 66*a*, a belt motor 69 for driving the belt-driving roller 63, and a fixing motor 73 for driving the pressure roller 72, and the like are installed.

The process-driving motor 36 and the process cartridge (the K process) 30, which contains the black toner, are connected through a K process-driving unit 37, as a driving force transmission mechanism including gears, and the like, so as to be able to transmit power. Moreover, the K process 30K and the process cartridge (C process) 30C, which contains the cyan toner, are connected through a C process-driving unit 38*a*, as a driving force transmission mechanism including gears, and the like, so as to be able to transmit power. Similarly, the C process 30C and the process cartridge (M process) 30 M, which contains the magenta toner, are connected through an M process-driving unit 38*b*, as a driving force transmission mechanism including gears, and the like, so as to be able to transmit power. Furthermore, the M process 30M and the process cartridge (Y process) 30Y, which contains the yellow toner, are connected through a C process-driving unit 38*a*, as a driving force transmission mechanism including gears, and the like, so as to be able to transmit power. In addition, the structure is such that the rotational driving force that is generated by the process-driving motor 36 is transmitted sequentially through the K process-driving unit 37, the K process 30K, the C process-driving unit 38*a*, the C process 30C, the M process-driving unit 38*b*, the M process 30M, the Y process-driving unit 38*c*, and the Y process 30Y.

The paper-conveying roller 53 and the resist roller 54 (shown in FIG. 1) that include the paper-conveying mechanism, in the paper-conveying unit 50, are connected to the conveying motor 56, so as to be able to transmit power, through a conveying system driving unit 57, as a driving force conveying mechanism including gears, and the like. The pickup roller 51 and the paper supply roller 52 (shown in FIG. 1), which include the paper supply mechanism in the paper-conveying unit 50 are structures so as to be able to transmit the driving force through the paper supply system driving unit 58, as a driving force transmission mechanism including gears, and the like, from the paper-conveying mechanism. A clutch 59 is provided in the paper supply system driving unit 58, enabling the intermittent rotational driving of the pickup roller 51 and the paper supply roller 52 (shown in FIG. 1) while the paper-conveying mechanism is being driven. That is, as shown in FIG. 1, the paper supply system driving unit 58 and the clutch 59, in FIG. 4, are structured so as to be in a state wherein the pickup roller 51 and the paper supply roller 52 can rotate freely when the paper P that has been conveyed in the direction of paper-conveying by the pickup roller 51 and the paper supply roller 52 has arrived at the resist roller 54 and the state is such that the paper P can be conveyed by the resist roller 54 and the paper-conveying roller 53.

The cleaning roller 66*a* and the cleaner-driving motor 66*b* are connected, so as to be able to transmit power, through a cleaner-driving unit 66*c*, including gears, and the like.

The fixing motor 73 and the pressure roller 72 are connected, so as to be able to transmit power, through a fixing system driving unit 74, including gears, and the like. The rotational driving force that is propagated to the pressure roller 72 is transmitted to the paper-ejecting roller 83 through the paper-ejecting system driving unit 75, including gears, and the like.

Blocking Member (or Blocking Plate) Driving Unit

The belt motor 69 and the belt-driving roller 63 are connected, so as to be able to transmit power, through a belt-driving unit 69*a* (the image supporting member driving unit), including gears, and the like. In other words, the driving force transmission mechanism is structured from a belt motor 69 for moving the surface of the belt 61 (as shown in FIG. 2*b*) by the belt-driving unit 59*a*.

Furthermore, the blocking plate driving unit 69*b*, as the blocking member driving unit for rotationally driving the blocking disk 65*c*, provided in the density-detecting unit 65, is connected to the belt-driving unit 69*a* so as to be able to transmit power. That is, the belt-driving unit 69*a* and the blocking plate driving unit 69*b* are structured so that the blocking disk 65*c* (shown in FIGS. 2*a* and 2*b*) can be rotated constantly through the constant transmission of the rotational driving force of the belt motor 69 to the belt-driving unit 69*a* and the blocking plate driving unit 69*b* when the belt motor 69 is being driven rotationally.

Example of Embodiment 1

Figure 5A:
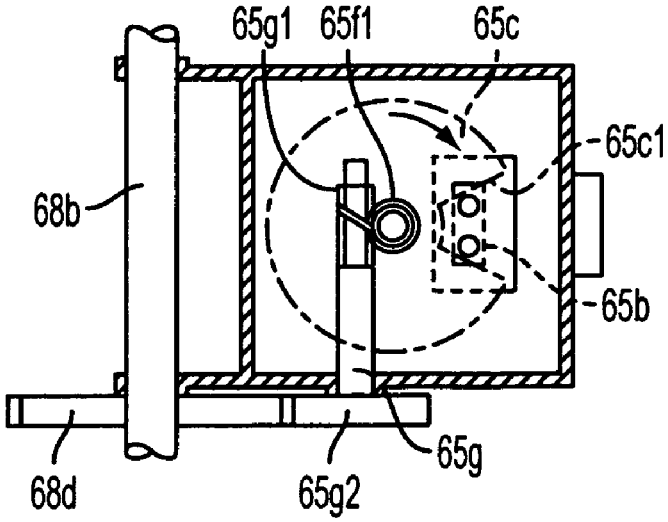
FIGS. 5*a* and 5*b* are expanded views illustrating an example of embodiment in a blocking plate driving unit.

In the below, FIGS. 5*a* and 5*b* will be used to explain an example of embodiment of the structure of the blocking disk-driving unit that is described above. (See the blocking plate driving unit 69*b* in FIG. 4.) FIG. 5*a* is a drawing when the structure is viewed from above, and FIG. 5*b* is a drawing when the structure is viewed from the side.

As is shown in FIG. 5*a*, a worm gear 65*g*1 (a third gear) is formed so as to mate with the disk-supporting axel gear 65*f*1 at one end of a disk-driving gear 65*g*. Moreover, at the other end part of the disk-driving gear 65*g*, an input gear 65*g*2 (a second gear) that can rotate in a vertical plane that is parallel to the direction of motion of the surface of the belt 61 (shown in FIG. 5*b*) is formed. That is, the worm gear 65*g*1 is structured so as to be able to convert the rotation of the input gear 65*g*2 into rotation in a plane that is parallel to the plane of rotation of the blocking disk 65*c*. Furthermore, a first gear 68*d* is supported on the sensor frame support axel 68*b* so as to be able to rotate. This first gear 68*d* is structured so as to mate with the input gear 65*g*2 in the same plane.

Figure 5B:
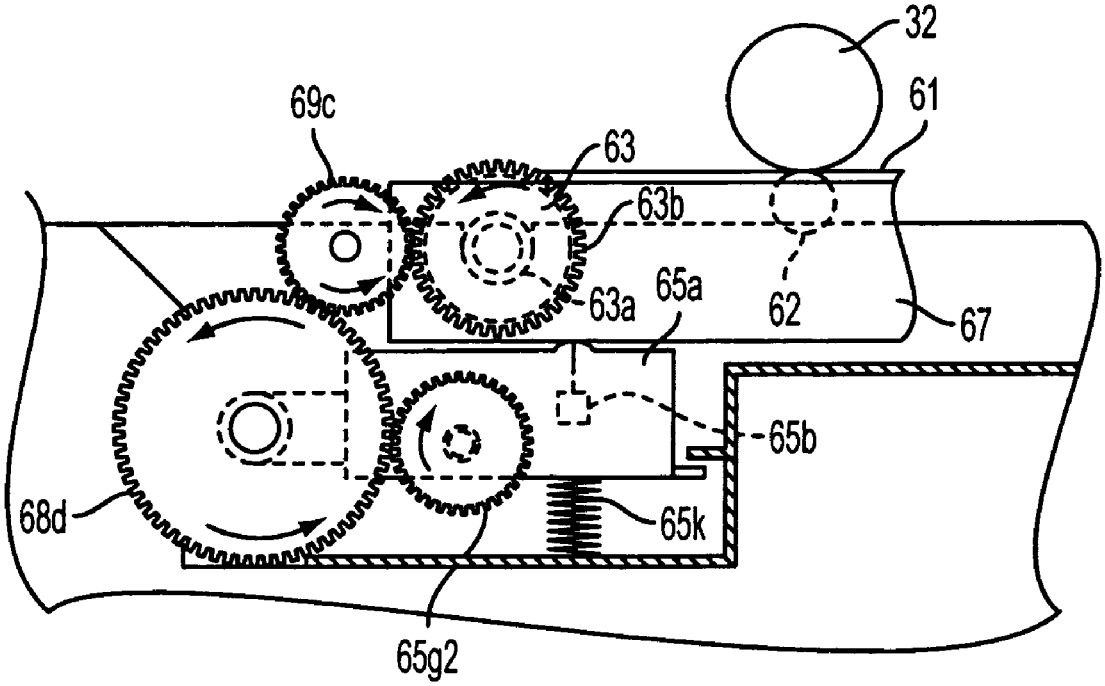

As is shown in FIG. 5*b*, the belt-driving gear 63*b* is provided attached rigidly to the axel of rotation 63*a* of the belt-driving roller 63 (so that there is no relative movement in the rotational direction between the belt-driving roller 63 and the axel of rotation 63*a*). In the body frame 68, a belt motor gear 69*c*, for transmitting the rotational driving force from the belt motor 69 (shown in FIG. 4) is supported so as to be able to rotate, and the belt motor gear 69*c* is disposed so as to mate with the belt-driving gear 63*b* and the first gear 68*d*, on both sides. That is, when the belt motor gear 69*c* is rotated in the clockwise direction in the figure, the first gear 68*d* and the belt-driving gear 63*b* rotate in the counterclockwise direction in the figure.

FIGS. 5*a* and 5*b* show a drive system that moves the blocking disk 65*c* to expose density sensor 65*b*. It is appreciated that other types of drive systems may be used to control the position of the blocking disk 65*c* including, but not limited to, planetary gears, gearing that turns blocking disk 65*c* directly (for instance, where notched part 65*c*1 may be a window in blocking disk 65*c*, thereby ensuring gear teeth around the periphery of blocking disk 65*c*), and the like.

With respect to the use of planetary gears, one may have the planetary gears arranged such that a first rotation direction controls the movement of the drive belt driving roller 63 and the second rotation direction controls the movement of the blocking disk 65*c*. For example, the first rotation direction may be one of clockwise and counterclockwise and the second rotation direction being the other of clockwise and counterclockwise. In this example, the belt 61 may be controlled during normal operation and during the toner density sensing operation. By modifying the direction of the rotation of the planetary gears such that the new direction controls the blocking disk 65*c*, one may use the planetary gears to position the belt and sense toner density while minimizing the time period during which the sensors 65*b* may accumulate toner buildup. In this alternate example, the blocking disk 65*c* is operated intermittently, preferably only during a sensing operation.

Action and Effects According to Various Structures

Next the various figures will be referenced to explain the action and effects through the structure according to the embodiment described above. Given the structure of the present embodiment (in FIG. 1 through FIG. 4), when adjusting the image the process cartridges 30, the scanner units 40, and the transfer units 60 are driven as described below under the control of the control unit 90.

Referencing FIG. 1, the control unit 90 when starting the image adjusting operations, first drives the process-driving motor 36 and the belt motor 69 (shown in FIG. 4) to drive the belt-driving roller 63 and the blocking disk 65*c* (shown in FIGS. 2*a* and 2*b*) in the transfer unit 60, and the photosensitive drum 32, developing roller 33, and supply roller 34 of the process cartridges 30. Next the control unit 90 operates the scanner units 40 with the appropriate timing based on the output that is generated periodically by the density sensor 65*b* (shown in FIGS. 2*a* and 2*b*) according to changes between the blocked state and the exposed state in the blocking disk 65*c* (shown in FIGS. 2*a* and 2*b*) to form an electrostatic latent image, corresponding to the mark image, on the photosensitive drum 32. Moreover, this electrostatic latent image is developed by the toner that is supported on the peripheral surface of the developing roller 33. The developed image is transferred to the belt 61 by the transfer bias. Given this, the mark image, made of toner, is held on the surface of the belt 61 by the transfer bias voltage. Then the mark image that is supported on the surface of the belt 61 is moved, following the movement of the surface of the belt 61, by the rotation of the belt-driving roller 63. When this mark image passes the detecting position of the density-detecting unit 65 (a position that faces the opening part 67*b* and the density sensor 65*b* in FIG. 2*b*), a signal corresponding to the toner density of the mark image is generated by the density-detecting unit 65. The image adjustment is performed by the control unit 90 based on this signal. For example, the developing bias and the transfer bias are adjusted according to the toner density. When the image adjustment has been completed, the mark image is removed from the surface of the belt 61 by a belt cleaner 66.

Here the density sensor 65*b* generates an output according to the state of the blocking disk 65*c* (the angular phase), along with the state of the surface of the belt 61 (the presence vs. absence of toner, and the density thereof). In particular, in the density sensor 65*b*, an output corresponding to the blocked state and an output corresponding to the exposed state can be produced periodically. Consequently, the control unit 90 is able to terminate the image adjusting operation in a state wherein the density sensor 65*b* is blocked by the blocking disk 65*c*, doing so through stopping the belt motor 69 (shown in FIG. 4) during the blocked state. This enables the control of the blocking disk 65*c* to minimize the adherence of foreign matter onto the density sensor 65*b* when not in an image-adjusting operation. Here, the control is enabled through the use of a simple structure.

In addition, the time is known in advance that elapses before the extremely small dots that are formed from toner, which are formed on the belt 61 at the developing position, facing the photosensitive drum 32 and the transfer roller 62 of each of the process cartridges 30 (30Y, 30M, 30C and 30K) arrive at the detecting position. Consequently, the operational timing of the process cartridges and the scanner unit 40 can be controlled as appropriate by the control unit 90 so that the leading edge (in the direction of conveyance of the belt 61) of the mark image that is formed at the developing position can be detected by the density sensor 65*b*.

Moreover, when transitioning the state of the blocking disk 65*c* from the blocked state to the exposed state, or when transitioning the state of the blocking disk 65*c* from the exposed state to the blocked state, color shift correction can be performed based on the timing of the rising edge and the falling edge of the signal that is produced from the density sensor 65*b*.

Furthermore, in the structure of the present embodiment the disk-driving gear 65*g* (shown in FIGS. 2*a* and 2*b*) for structuring the blocking plate driving unit 69*b* (shown in FIG. 4) for driving the blocking disk 65*c* in the density-detecting unit 65 can be linked directly to the belt motor 69, which is the driving force transmission mechanism for driving the belt-driving roller 63, and to the belt-driving unit 69*a* (shown in FIG. 4). Consequently, while the belt-driving roller 63 is being driven, the blocking disk 65*c* is always rotated. Given this, the driving of the blocking disk 65*c* can be achieved with a simple mechanism without preparing a clutch mechanism or a driving source, such as a special solenoid or motor, for driving the blocking disk 65*c*. In particular, because the blocking disk 65*c* is driven rotationally, without reciprocating motion, there is little vibration. Consequently, there is no problem with noise, or the like, even when the blocking disk 65*c* is driven at the same time as the belt-driving roller 63 that can be driven continually for a relatively long time.

Alternatively, the driving force may alternately drive the belt-driving roller 63 and the blocking disk 65*c* (for instance, through the use of planetary gears).

In addition, referencing FIG. 2*b* and FIG. 3, in the structure in the present embodiment, the sensor frame 65 is supported swivelably, centered on the sensor frame support axel 68*b* that is provided in the body frame 68, where the transfer frame bottom plate 67*a* that supports the belt 61, and the protruding part 65*a*2 on the top end of the sensor frame 65*a* make contact to set the clearance between the density sensor 65*b* and the surface of the belt 61. That is, the clearance is represented by the following formula when the transfer frame bottom plate 67*a* is in contact with the protruding part 65*a*2:

Clearance=(difference in height between the bottom edge of the density sensor 65*b* and the protruding part 65*a*2)+(difference in height between the axis of the belt-driving roller and the bottom surface of the transfer frame bottom plate 67*a*)−(height of the density sensor 65*b*)−(diameter of the belt-driving roller 63+thickness of the belt 61).

Here, the "height" refers to the height, along a vertical line that is in a direction that is parallel to the light path between the density sensor 65*b* and the belt 61.

Consequently, given the structure in the present embodiment, the clearance can be set with increased precision.

Operation and Effects of Various Structures

Next, the operation and effects of the structure in the example of embodiment described above will be explained, referencing FIGS. 5*a* and 5*b*. Given the structure in the present example of embodiment, there are the operations and effects described below in addition to the operations and effects in the embodiment described above.

Given the structure in the present example of embodiment, the belt motor 69 (shown in FIG. 4) is driven rotationally in order to drive rotationally the belt-driving roller 63, where the rotational driving force of this belt motor 69 is transferred to the belt-driving gear 63*b* and a first gear 68*d* through the belt motor gear 69*c*. As a result, the blocking disk 65*c* is rotated through the transmission of the rotational driving force to the disk-supporting axel gear 65*f*1 through the input gear 65*g*2 and the worn gear 65*g*1 from the first gear 68*d*, along with the belt-driving roller 63 being rotated to move the surface of the belt 61. At this time, the first gear 68*d* rotates in the direction wherein the input gear 65*g*2, which is supported on the sensor frame 65*a*, is pushed up facing the transfer frame 67. Consequently, in the image adjusting operations, a force in the direction for biasing towards the transfer frame 67 is always applied to the sensor frame 65*a*. Consequently, it is possible to control the variability in the clearance in the image adjusting operations. Furthermore, because it is possible to stabilize the clearance even when the load on the spring (the pressure on the spring) in the sensor frame push-up spring 65*k* has been reduced, efficiency is improved when attaching and removing this transfer frame 67 to and from the body frame 68.

In one embodiment, the blocking disk 65*c* may operate continuously with the rotation of belt driving roller 63. In another embodiment, the blocking disk 65*c* may operate alternatively with the rotation of belt driving roller 63.

In some embodiments, a cleaning brush 65*d* is not used although the blocking disk 65*c* is periodically opened to reveal the sensor 65*b*. In other embodiments, a cleaning brush 65*d* is provided on the bottom surface of the blocking disk 65*c*. Moreover, as described above, during the image adjusting operations, the blocking disk 65*c* can be driven rotationally. Consequently, even if toner were to fall towards the density sensor 65*b* from the belt 61 during the image-forming operations, the toner would be removed by the cleaning brush 65*d*, in some embodiments where the cleaning brush 64 is provided. In addition, the belt motor 69 can be stopped in a situation wherein foreign material has been removed from the density sensor 65*b*. Consequently, it is possible to prevent the toner from adhering to the density sensor 65*b*, or from being left for long periods of time on the density sensor 65*b* when there are no image-adjusting operations. Consequently, the loss of the density-detecting ability of the density sensor 65*b* due toner adhering on the light-emitting unit 65*b*1 or the light-receiving unit 65*b*2 of the density sensor 65*b* can be prevented.

Given the structure according to one or more embodiments, a reference plate 65*e* is disposed at the bottom surface of the blocking disk 65*c*. Consequently, it is possible to simplify the structure for performing calibration in the density sensor 65*b*.

Alternative Embodiments

Note that the embodiment and example of embodiment, as described above, are nor more than merely illustrations of an embodiment and an example of embodiment according to the present invention and in no way is the present invention limited to the example of embodiment or embodiment, and, of course, a variety of modifications can be performed in a range that does not deviate from the essence of the present invention. Various suggestions are made below regarding alternate examples. Of course, the present invention is not limited to that which is described below as alternate examples.

(i) The image-forming devices to which the present invention can be applied are not limited to laser printers. Moreover, the present invention may also be applied to monochrome image-forming devices.

(ii) The belt 61 in the embodiment described above was a so-called intermediate transfer belt wherein, after the image was first transferred using toner from the photosensitive drum 32 it was the transferred again to the paper P. Moreover, the transfer unit 60 in the embodiment was structured so that the belt 61 made two cycles in forming an image on a single sheet of paper P. Given the structure, image-forming devices can be achieved using an intermediate transfer belt with a relatively small device structure. It would be simple to change, as appropriate, the structure of the paper-conveying path (the paper-conveying unit 50) so that, instead of the structure described above, a structure is used wherein the belt 61 functions as an intermediate transfer belt to perform the image formation on one sheet of paper P with only a single cycle of the belt 61.

Furthermore, instead of the structure described above, the belt 61 may also be a conveying belt for conveying the paper P. In this case, the image is transferred directly from the photosensitive drum 32 to the paper P by the toner. Moreover, the positional relationships between the heating rollers 71 and the pressure rollers 72 may be reversed from the form illustrated in FIG. 1. That is to say, the heating rollers 71 may be disposed facing the surface to which the toner is adhered on the paper P. Even in this case, the image adjusting operations are performed through forming a mark image on the surface of the belt 61, so the belt 61 is the "image supporting member" in the present invention. Note that the belt cleaner 66 need not constantly contact the belt 61.

(iii) The blocking plate driving unit 69*b* for performing the transmission of the rotational driving force to a disk-driving gear 65*g* from the belt motor 69 can use a universal joint instead of a gear. Moreover, a bevel gear can be used instead of a worm gear.

(iv) In the embodiment described above, the driving force transmission to the density-detecting unit 65 (the disk-supporting axel gear 65*f*1) is performed through a belt-driving unit 69*a* and a blocking plate driving unit 69*b* from the belt motor 69, as illustrated in FIG. 4.

Figure 6:
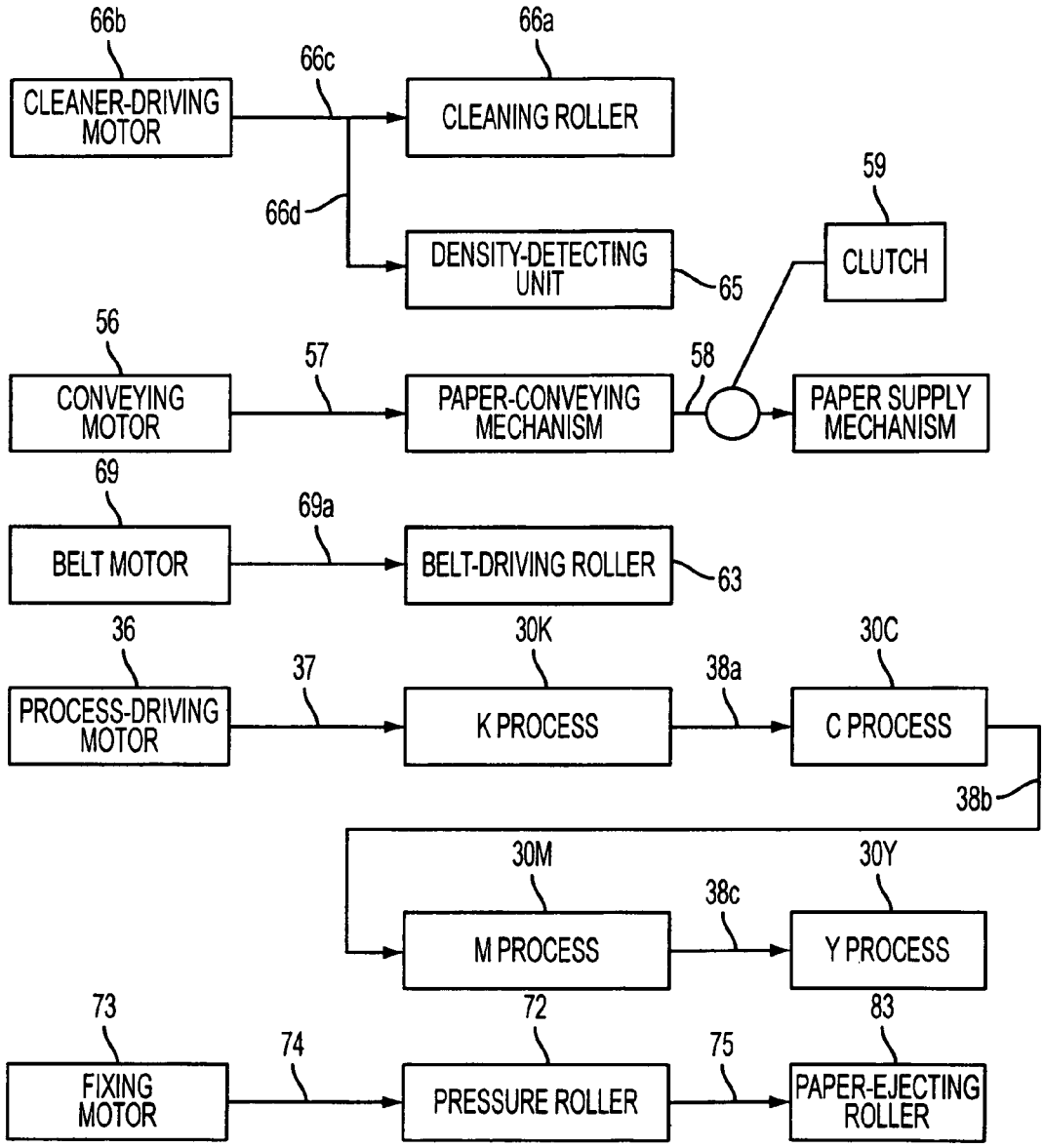
FIG. 6 is a block diagram illustrating the structure of a driving force transmission mechanism of a laser printer that includes an alternate example of a blocking plate driving unit.
Figure 7:
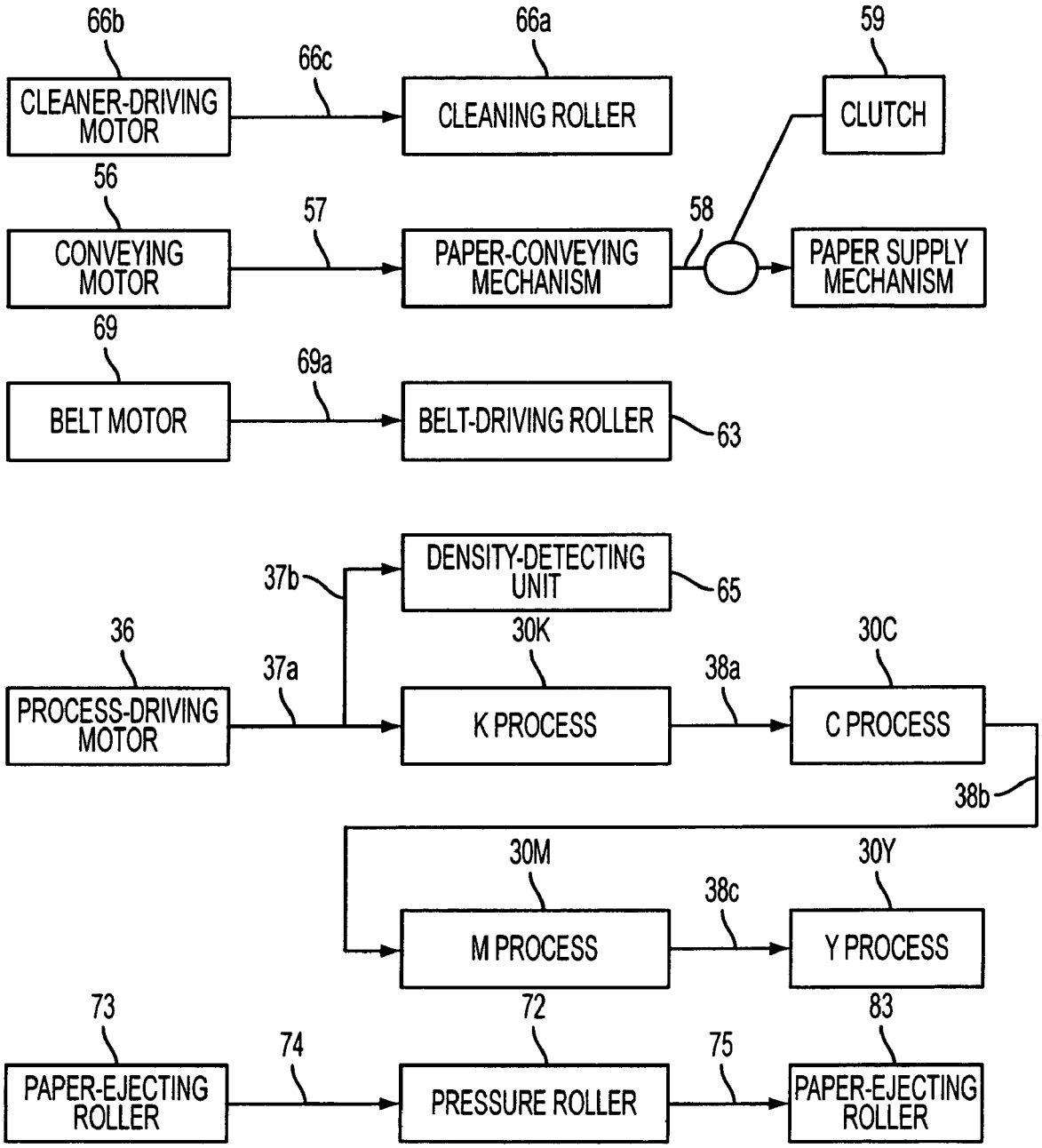
FIG. 7 is a block diagram illustrating the structure of a driving force transmission mechanism of a laser printer that includes an alternate example of a blocking plate driving unit.
Figure 8:
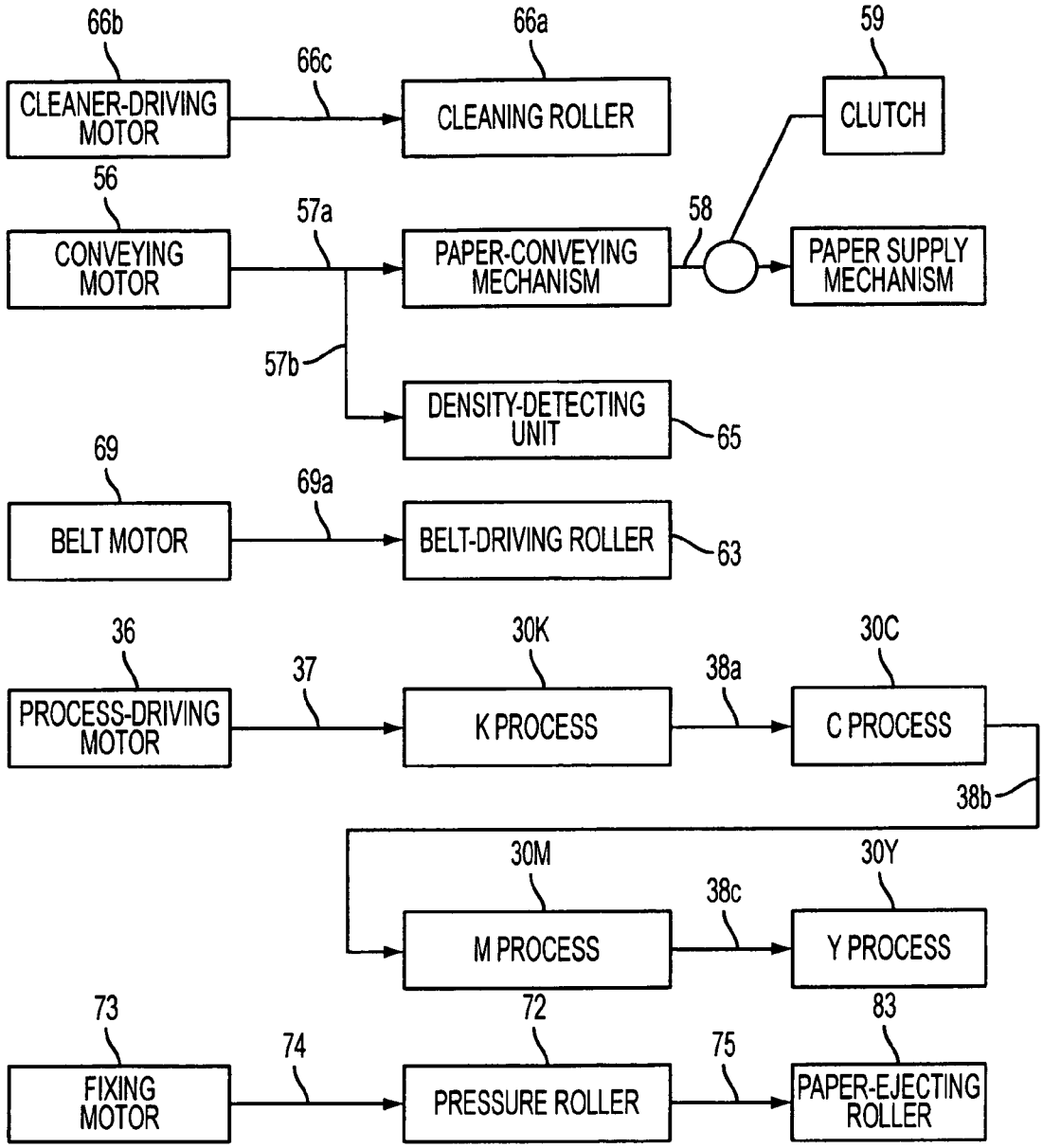
FIG. 8 is a block diagram illustrating the structure of a driving force transmission mechanism of a laser printer that includes an alternate example of a blocking plate driving unit.

However, the blocking plate driving unit for driving the density-detecting unit 65 can use a variety of structures, as shown in FIG. 6 through FIG. 8, instead of the structure described above. An alternate example of a structure for a driving force transmission mechanism for a laser printer that includes an alternate example of the blocking plate driving unit will be explained below. At this time, the same codes will be used for structural elements that have the same functions as in the embodiment described above, and the explanations in the embodiment described above shall be used for the explanations thereof.

For example, as is shown in FIG. 6, a blocking plate driving unit 69*b* may be provided so that the cleaner-driving motor 66*b*, which connects directly to the cleaning roller 66*a* of the belt cleaner 66, is connected directly to the cleaner-driving unit 66*c*. Given this structure, the driving force from the cleaner-driving motor 66*b* is always transmitted to the blocking plate driving unit 69*b* when the cleaning roller 66*a* is driven by the cleaner-driving motor 66*b* (when forming an image or when performing image adjusting operations), so that the blocking disk 65*c* (shown in FIGS. 2*a* and 2*b*) can always rotate.

Moreover, as is shown in FIG. 7, a blocking plate driving unit 37*b* may be provided such that the K driving unit 37*a*, which is connected to each of the process cartridges 30, is connected directly to the process-driving motor 36. Given the structure, when the process cartridge 30 is driven by the process-driving motor 36 when forming an image, the driving force from the process-driving motor 36 is always transferred to the blocking plate driving unit 37*b*, so the blocking disk 65*c* (shown in FIGS. 2*a* and 2*b*) can always rotate.

Furthermore, as is shown in FIG. 8, a blocking plate driving unit 57*b* may be provided so that the conveying motor 56 is connected directly to the conveying system driving unit 57*a*, which is connected to the paper-conveying roller 53, etc. Given the structure, the driving force from the conveying motor 56 is always transmitted to the blocking plate driving unit 57*b* when the paper-conveying roller 53, and the like, are driven by the conveying motor 56 when forming an image, and so the blocking disk 65*c* (shown in FIGS. 2*a* and 2*b*) may constantly rotate.

(v) A rubber blade or a synthetic resin plate, or the like, may be used instead of the cleaning brush 65*d* in the example of embodiment described above.

(vi) The driving force may be intermittently applied to the blocking place 65*c*. By only operating the blocking place 65*c* to rotate to expose the sensor 65*b*, the amount of accumulation of toner on the sensor 65*b* may be minimized. In this alternate embodiment, one may eliminate cleaning brush 65*d*. In another aspect, the cleaning brush 65*d* may be kept to clean the sensor 65*b* in due course.

What is claimed is:

1. An image-forming device for forming images using a developing agent, said image-forming device comprising:

a supporting member having a surface capable of supporting said developing agent;

a supporting member driving unit capable of driving so as to move said surface of said supporting member;

a density sensor capable of generating a signal according to the density of said developing agent on said surface, disposed facing said surface of said supporting member;

a blocking member, disposed between said density sensor and said supporting member, so as to be able to be positioned in a blocked state capable of blocking the density sensor relative to said supporting member and an exposed state capable of exposing said density sensor to said supporting member; and a blocking member driving unit structured so as to change the state of said blocking member between said blocked state and said exposed state through transmission of a driving force from said supporting member driving unit, wherein said blocking member is structured from a disk having a notch, and wherein said blocking member driving unit is structured so as to rotate said disk.

2. An image-forming device according to claim 1, wherein said blocking member is provided with a cleaning member capable of removing foreign material adhered to said density sensor.

3. An image-forming device according to claim 1, wherein said blocking member provides a reference plate capable of calibration of said density sensor.

4. An image forming device according to claim 1, wherein the transmission of the driving force from said supporting member driving unit is a constant transmission of said driving force.

5. An image forming device according to claim 1, wherein the transmission of the driving force from said supporting member driving unit is an intermittent transmission of said driving force.

6. An image-forming device for forming images using a developing agent, said image-forming device comprising:

a supporting member having a surface capable of supporting said developing agent;

a supporting member driving unit capable of driving so as to move said surface of said supporting member;

a density sensor capable of generating a signal according to the density of said developing agent on said surface, disposed facing said surface of said supporting member;

a blocking member, disposed between said density sensor and said supporting member, so as to be able to be positioned in a blocked state capable of blocking the density sensor relative to said supporting member and an exposed state capable of exposing said density sensor to said supporting member;

a blocking member driving unit structured so as to change the state of said blocking member between said blocked state and said exposed state through transmission of a driving force from said supporting member driving unit an image-forming unit capable of supporting said developing agent on said surface of said supporting member;

a state notifying unit capable of generating signals according to the state of said blocking member; and a controlling unit capable of controlling the operations of said image-forming unit based on the signals from said state notifying unit.

7. An image-forming device for forming images using a developing agent, said image-forming device comprising:

a first member that is driven by a driving source during image formation;

a supporting member having a surface capable of supporting said developing agent;

a density sensor capable of generating a signal according to the density of said developing agent on said surface, disposed facing said surface of said supporting member;

a blocking member, disposed between said density sensor and said supporting member, so as to be able to be positioned in a blocked state for blocking the density sensor relative to said supporting member and an exposed state for exposing said density sensor to said supporting member; and a blocking member driving unit structured so as to change the state of said blocking member between said blocked state and said exposed state when said first member is driven by said driving source through transmission of a driving force from said driving source, wherein said blocking member is structured from a disk having a notch; and wherein said blocking member driving unit is structured so as to rotate said disk.

8. An image-forming device according to claim 7, wherein said blocking member is provided with a cleaning member capable of removing foreign material adhered to said density sensor.

9. An image-forming device according to claim 7, wherein said blocking member provides a reference plate capable of calibration of said density sensor.

10. An image forming device according to claim 7, wherein the transmission of the driving force from said driving source is a constant transmission of said driving force.

11. An image forming device according to claim 7, wherein the transmission of the driving force from said driving source is an intermittent transmission of said driving force.

12. An image-forming device for forming images using a developing agent, said image-forming device comprising:

a first member that is driven by a driving source during image formation;

a supporting member having a surface capable of supporting said developing agent;

a density sensor capable of generating a signal according to the density of said developing agent on said surface, disposed facing said surface of said supporting member;

a blocking member, disposed between said density sensor and said supporting member, so as to be able to be positioned in a blocked state for blocking the density sensor to said supporting member;

a blocking member driving unit structured so as to change the state of said blocking member between said blocked state and said exposed state when said first member is driven by said driving source through transmission of a driving force from said driving source, an image-forming unit capable of supporting said developing agent on said surface of said supporting member;

a state notifying unit capable of generating signals according to the state of said blocking member; and a controlling unit capable of controlling the operations of said image-forming unit based on the signals from said state notifying unit.

13. A transfer device capable of transferring onto a recording medium a developing agent that is arranged in the shape of an image comprising:

an intermediate transfer member capable of supporting said developing agent on a surface;

a density sensor capable of generating a signal according to the density of said developing agent on said surface, disposed facing said surface of said intermediate transfer member;

a blocking member, disposed between said density sensor and said intermediate transfer member, so as to be able to be positioned in a blocked state for blocking the density sensor relative to said intermediate transfer member, and an exposed state for exposing said density sensor to said intermediate transfer member; and a blocking member driving unit structured so as to change the state of said blocking member between said blocked state and said exposed state through transmission of a driving force from an intermediate transfer member driving unit, wherein said blocking member is structured from a disk having a notch; and wherein said blocking member driving unit is structured so as to rotate said disk.

14. A transfer device according to claim 13, wherein:

said blocking member is provided with a cleaning member capable of removing foreign material adhered to said density sensor.

15. A transfer device according to claim 13, wherein said blocking member provides a reference plate capable of calibration of said density sensor.

16. A transfer device according to claim 13, further comprising:

a sensor frame capable of supporting said disk and said density sensor;

a transfer frame capable of supporting said intermediate transfer member; and a main body frame capable of supporting said sensor frame so as to be able to swivel between a contact position wherein said sensor frame is in contact with said transfer frame, and a separated position wherein said sensor frame is separated from said transfer frame;

and wherein:

said blocking member driving unit comprises:

a first gear supported by said body frame so as to be able to rotate in a vertical plane that is parallel to the direction of movement of said surface of said intermediate transfer member;

a second gear, supported on said sensor frame, that meshed in the same plane as first gear; and a third gear, supported by said sensor frame, that converts the rotation of said second gear into rotation within a plane that is parallel to the plane of rotation of said disk and that is parallel to said surface of said intermediate transfer member.

17. A transfer device according to claim 13, wherein the transmission of the driving force from said intermediate transfer member driving unit is a constant transmission of said driving force.

18. A transfer device according to claim 13, wherein the transmission of the driving force from said intermediate transfer member driving unit is an intermittent transmission of said driving force.

19. A transfer device capable of transferring onto a recording medium a developing agent that is arranged in the shape of an image comprising:

an intermediate transfer member capable of supporting said developing agent that is arranged in the shape of an image on a surface;

a cleaner, driven by a driving source, capable of cleaning said surface of said intermediate transfer member;

a density sensor capable of generating a signal according to the density of said developing agent on said surface, disposed facing said surface of said intermediate transfer member;

a blocking member, disposed between said density sensor and said intermediate transfer member, so as to be able to be positioned in a blocked state for blocking the density sensor relative to said intermediate transfer member, and an exposed state for exposing said density sensor to said intermediate transfer member; and a blocking member driving unit structured so as to change the state of said blocking member between said blocked state and said exposed state through transmission of a driving force from the driving source when said cleaner is driven.

20. A transfer device according to claim 19, wherein:

said blocking member is provided with a cleaning member capable of removing foreign material adhered to said density sensor.

21. A transfer device according to claim 19, wherein said blocking member provides a reference plate capable of calibration of said density sensor.

22. A transfer device according to claim 19, wherein:

said blocking member is structured from a disk having a notch; and said blocking member driving unit is structured so as to rotate said disk.

23. A transfer device according to claim 22, further comprising:

a sensor frame capable of supporting said disk and said density sensor;

a transfer frame capable of supporting said intermediate transfer member; and a main body frame capable of supporting said sensor frame so as to be able to swivel between a contact position wherein said sensor frame is in contact with said transfer frame, and a separated position wherein said sensor frame is separated from said transfer frame;

and wherein:

said blocking member driving unit comprises:

a first gear supported by said body frame so as to be able to rotate in a vertical plane that is parallel to the direction of movement of said surface of said intermediate transfer member;

a second gear, supported on said sensor frame, that meshed in the same plane as first gear; and a third gear, supported by said sensor frame, that converts the rotation of said second gear into rotation within a plane that is parallel to the plane of rotation of said disk and that is parallel to said surface of said intermediate transfer member.

24. A transfer device according to claim 19, wherein the transmission of the driving force from said driving source is a constant transmission of said driving force.

25. A transfer device according to claim 19, wherein the transmission of the driving force from said driving source is an intermittent transmission of said driving force.

* * * * *

UNITED STATES PATENT AND TRADEMARK OFFICE

CERTIFICATE OF CORRECTION

PATENT NO. : 7,457,553 B2
APPLICATION NO. : 11/388988
DATED : November 25, 2008
INVENTOR(S) : Hiroshi Igarashi It is certified that error appears in the above-identified patent and that said Letters Patent is hereby corrected as shown below:

In Column 17, Claim 12, Line 26:

Please replace "sensor to" with --sensor relative to said supporting member and an exposed state for exposing said density sensor to--

Signed and Sealed this

Twenty-third Day of June, 2009

JOHN DOLL
*Acting Director of the United States Patent and Trademark Office*